US005439287A

United States Patent [19]

Roepke, Sr.

[11] Patent Number: 5,439,287

[45] Date of Patent: Aug. 8, 1995

[54] SHAKER FOR AEROSOL CAN

[76] Inventor: David W. Roepke, Sr., 4346 CR.RD. 59, Helena, Ohio 43435

[21] Appl. No.: 145,760

[22] Filed: Oct. 29, 1993

[51] Int. Cl.[6] ..... B01F 11/00

[52] U.S. Cl. ..... 366/130; 366/605; 451/415; 451/344

[58] Field of Search ..... 366/605, 110, 111, 129, 366/130, 197, 208, 211, 209; 51/170 R, 170 MT

[56] References Cited

U.S. PATENT DOCUMENTS

| | | | |
|---|---|---|---|
| 2,022,527 | 11/1935 | Schletz | 259/56 |
| 2,834,585 | 5/1958 | Oharenko | 366/209 |
| 3,327,431 | 6/1967 | Smith et al. | 51/163 |
| 3,330,537 | 7/1967 | Wason | 51/170 R |
| 3,735,962 | 5/1973 | Pagano | 259/72 |
| 4,318,622 | 3/1982 | Sterrenberg | 336/110 |
| 4,398,829 | 8/1983 | Shick | 366/605 |
| 4,420,262 | 12/1983 | Sterrenberg | 336/110 |
| 5,050,996 | 9/1991 | Allen | 336/211 |
| 5,098,193 | 3/1992 | Christensesn et al. | 366/130 |

*Primary Examiner*—Robert W. Jenkins

*Attorney, Agent, or Firm*—Jerry Semer

[57] ABSTRACT

The invention is basically an extruded or injection molded plastic part that is designed to fit on all drill or hand held sanders. The device has a C-shaped bracket of the size and length of an average aerosol can. The C-shaped bracket is adapted such as the aerosol can can be pressed through the opening and snapped in placed within the C-shaped cylindrical structure. In one embodiment of the invention the C-shaped bracket is attached to a rectangular base that is adapted to fit on the top of a hand held electric power sander. The base is either clipped or bolted to the top of the sander. In another embodiment of the invention the C-shaped bracket is attached to a much smaller rectangular base. This rectangular base has an axle running lengthwise through the base that is aligned slightly off center so that when the axle turns the C-shaped bracket will oscillate. The axle is adapted to fit within the chuck of an electric drill. When the axle is in placed and the drill is turned on the device will oscillate the can of paint within the device.

14 Claims, 5 Drawing Sheets

SHAKER FOR AEROSOL CAN

FIELD OF THE INVENTION

The present invention relates to an apparatus for shaking paint containers and the like and more particularly to an apparatus for shaking paint containers utilizing hand held power tools.

BACKGROUND OF THE INVENTION

As it is well-known paint must be thoroughly mixed and agitated prior to use in order to insure that pigment that normally settled out of the liquid carrier is returned into suspension therewith. Also paints that are sprayed by aerosol cans must be further shaken to insure that the propellant will propel the paint to the surface. There are many apparatuses known in the art for shaken relative large containers of paint and such apparatuses are typically installed within paint store for shaking many paint container at the same time. There are also apparatuses for mixing and stirring paints with shafts and plurality of blades at the lower ends that are inserted into open paint containers and rotated for stirring and mixing the paint. However, these apparatus shown in the prior art for shaking and mixing cannot be utilize in conjunction with aerosol spray paint containers or relative small size liquid paint containers. For containers of this size the user must typically shake the container manually prior to use. However, it is often difficult to return settled paint pigment into the suspension by manually shaken container, particularly when the paint is being used long after its manufacturer's packaging within the container. Thoroughly mixing is particularly important with aerosol spray containers since the presence of settled pigment may result in the spray nozzle becoming clogged or delivering the spray intermediately. Accordingly such containers of paint must be manually shaken for relatively long period of time to achieve proper mixing. Further, when there is only a small amount of paint left in aerosol cans it takes manually shaking for an extremely long time to get the last measure of paint.

Accordingly it is objective of the present invention to provide an apparatus and method for quickly and thoroughly shaking aerosol paint containers and relatively small liquid paint containers to insure that settled paint pigment are put back into suspension immediately before the paint is to be used. It is another objective of the present invention to provide an apparatus for shaking aerosol paint cans and small liquid paint cans and containers wherein the apparatus can be utilize in connections with hand held power tools of the type often found around the home. It is a further objective of the present invention to utilize hand held drills and hand held sanders for shaking aerosol and small paint cans.

SUMMARY OF THE INVENTION

The invention is basically an extruded or injection molded plastic part that is designed to fit on drills or hand held sanders. The device has a C-shaped bracket of the size and length of an average aerosol can. The C-shaped bracket is adapted such as the aerosol can be pressed through the opening and snapped in placed within the C-shaped cylindrical structure. In one embodiment of the invention the C-shaped bracket is attached to a rectangular base that is adapted to fit on the top of a hand held electric power sander. The base is either clipped or bolted to the top of the sander. In another embodiment of the invention the C-shaped bracket is attached to a much smaller rectangular base. This rectangular base has an axle running lengthwise through the base that is aligned slightly off center so that when the axle turns the C-shaped bracket will oscillate. The axle is adapted to fit within the chuck of an electric drill. When the axle is in placed and the drill is switch on, the device will oscillate the can of paint within the device.

DETAILED DESCRIPTION OF THE PREFERRED EMBODIMENT

Figure 1:
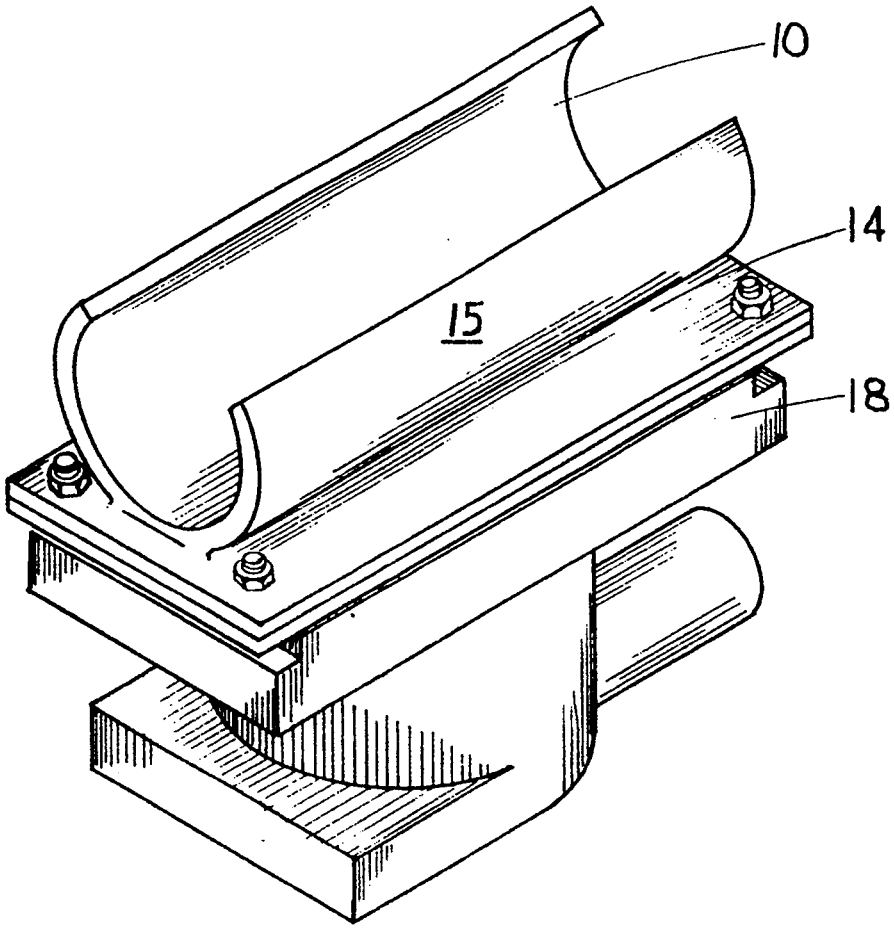
FIG. 1 is a perspective view of the device attached to a hand held sander by bolts.

FIG. 1 shows one embodiment of the invention that is attached to a hand held sander 18. FIG. 1 shows assembly 15 with a cylindrical C-shaped bracket 10 of the size and length of an average aerosol can 12. The C-shaped bracket 10 is adapted such the aerosol can 12 can be pressed through the opening and snapped in placed within the C-shaped bracket 10 cylindrical structure. In this embodiment attached to the C-shaped bracket 10 is a rectangular base 14. The rectangular base 14 is adapted to fit on the top of a hand held electric power sander 18. The base 14 is either clipped as in FIG. 2 or bolted to the top of sander 18 as in FIG. 1. In FIG. 1 the assembly 15 is attached to the sander by four nuts and bolts (three shown in FIG. 1 ) 30, 32 and 34 that are placed at each corner of the assembly 15 and in each corner of the sander to hold the device to the sander.

Figure 2:
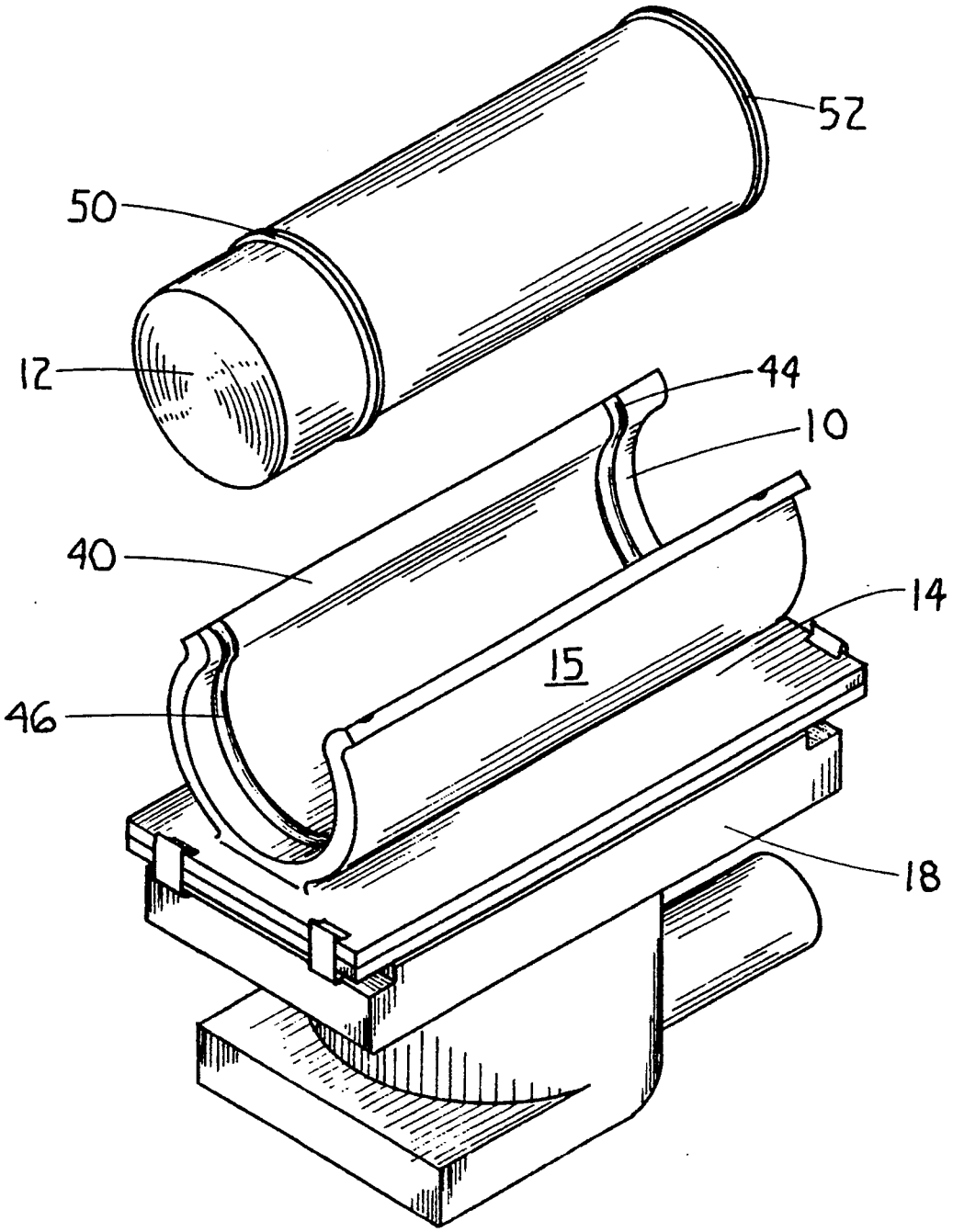
FIG. 2 is a perspective view of device attached to the hand held sander by clips.

FIG. 2 shows another embodiment of the invention. In FIG. 2 the end portions 40 and 42 of the C-shaped bracket 10 are flared slightly outward. When an aerosol can is pressed against these ends 40 and 42 the pressure against these ends forces the side of the C outward and the aerosol can more easily snaps into place within the C-shaped bracket 10. FIG. 2 also shows two grooves 44 and 46 around the inner circumference of the C-shaped bracket. On most aerosol cans there are ridges 50 and 52 around the outer circumference of the can at the very top and very bottom. The two grooves 44 and 46 around the inner circumference of the C-shaped bracket 10 correspond to the ridges 50 and 52 on the aerosol can. When the aerosol can is placed within the C-shaped bracket 10 the ridges 50 and 52 the aerosol can are placed within these grooves 44 and 46. This allows the can to fit better within the C-shaped bracket and also allows it when it is oscillating to rotate at a slow rate of speed. This causes better mixing.

The assembly 15 is attached to the sander by either a clipping means as shown in FIG. 2 or nuts and bolts as shown in FIG. 1. In FIG. 1 there is opening placed in the four corners of the sander and the device. Bolts (3 shown in FIG. 1) 30, 32 and 34 are placed within these four openings and they are attached with nuts. In FIG. 2 the device is attached to the sander by means of a U-shaped clips 70, 72 and 74 that are attached over the sides of the sander. In the preferred embodiment four U-shaped clips (three show 70, 72 and 74) in FIG. 2 are attached to the assembly 15 and form a pressure fit with the sander to hold the assembly securely on the top of the sander.

Figure 3:
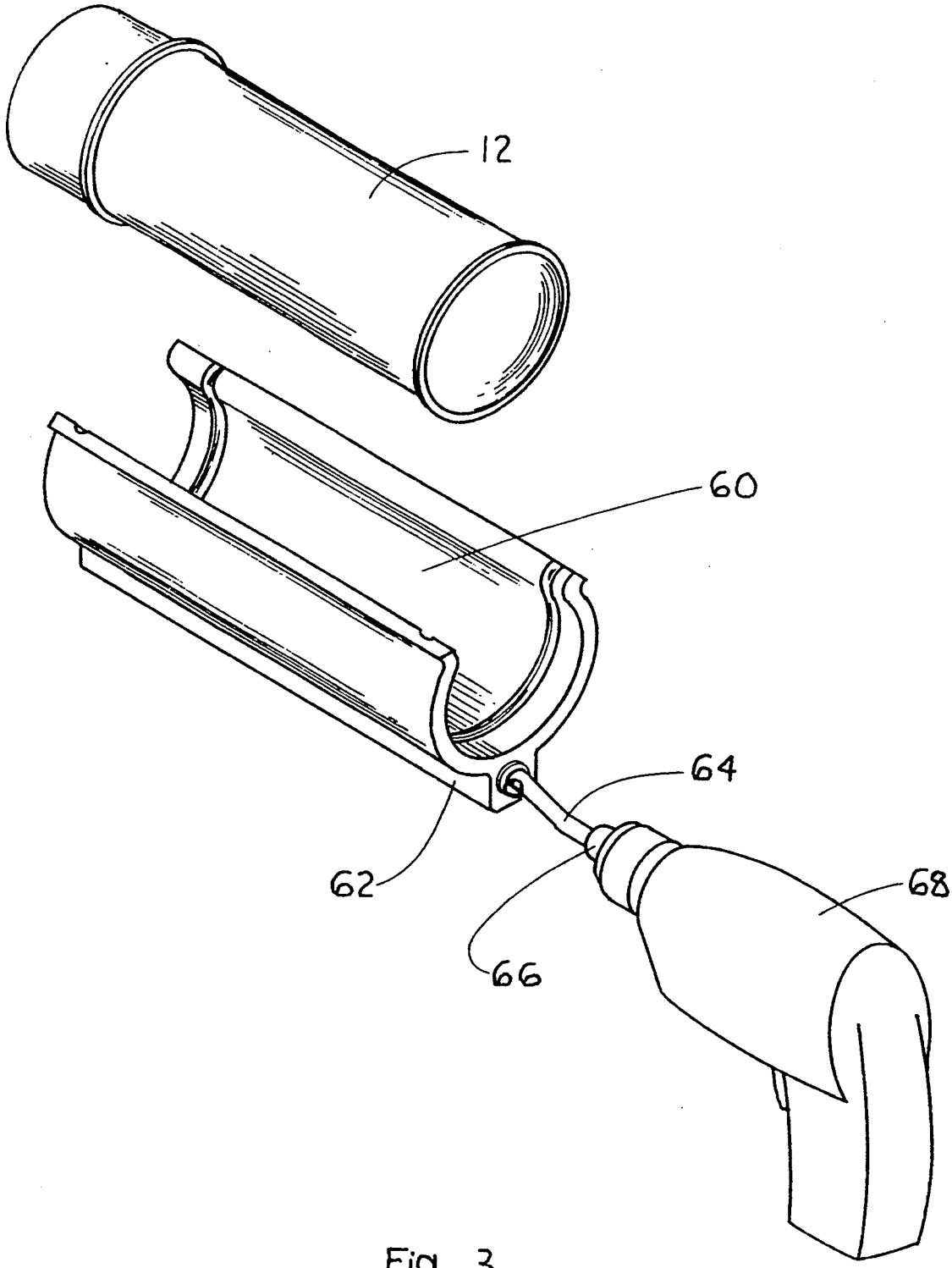
FIG. 3 is a perspective view of the device attached to a drill.
Figure 6:
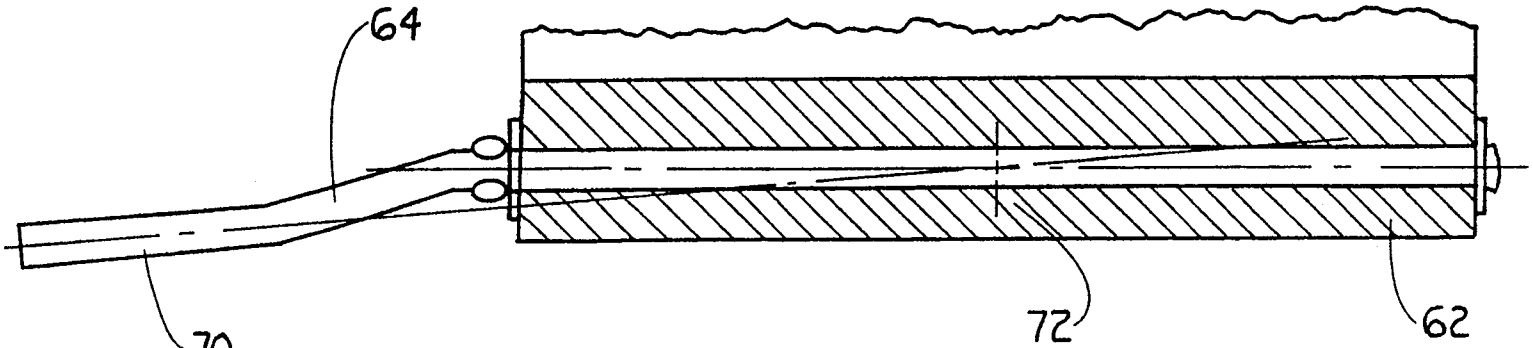
FIG. 6 is a cut away view of another embodiment of the device showing the axle.
Figure 5:
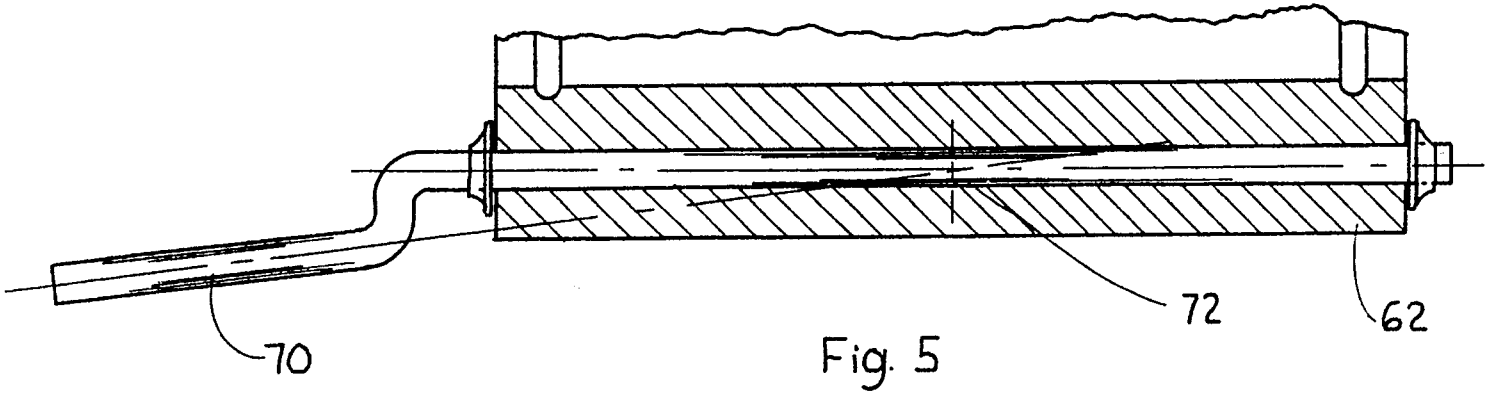
FIG. 5 is a cut away view of the device showing the axle.

FIG. 3 shows another embodiment of the device that is designed to be attached to a drill. FIG. 3 shows the C-shaped clip 60 similar to the one in FIG. 2. The C-shaped clip 60 of FIG. 3 acts exactly the same as the C-shaped clip 10 of FIG. 2. However, in FIG. 3 the rectangular base 62 is considerably smaller. Also running through the rectangular base 62 is a axle 64. This axle 64 is placed through the rectangular base 62 off set of center. The axle 64 as it comes out of the base is bent in two right angle as shown in FIG. 3. The axle 62 then straightens out so that it can be adapted to be placed in a chuck 66 of an electric drill 68. The axle 64 can also be placed in the rectangular base on center; however the one or both of the two curves must be on obtuse angle. FIG. 5 shows this configuration with one of the angles being obtuse. FIG. 6 shows the configuration with both angles being obtuse. To best obtain the oscillate the axle is designed such that the center line 70 of the portion of the axle that fits within the drill runs through the center 72 of the rectangular base 62 as shown in FIGS. 5 and 6. Oscillation of the can can be achieved by other methods known in the art.

Figure 9:
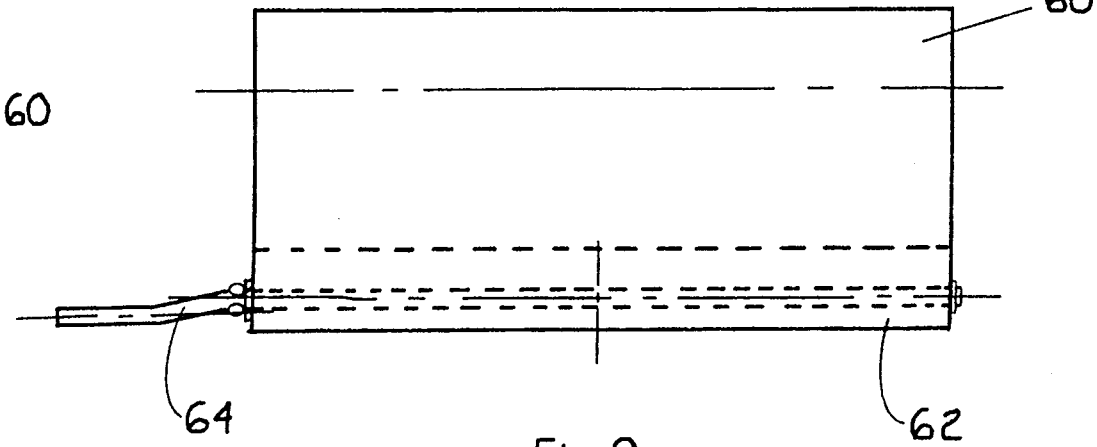
FIG. 9 is the side view of the embodiment shown in FIG. 4.
Figure 4:
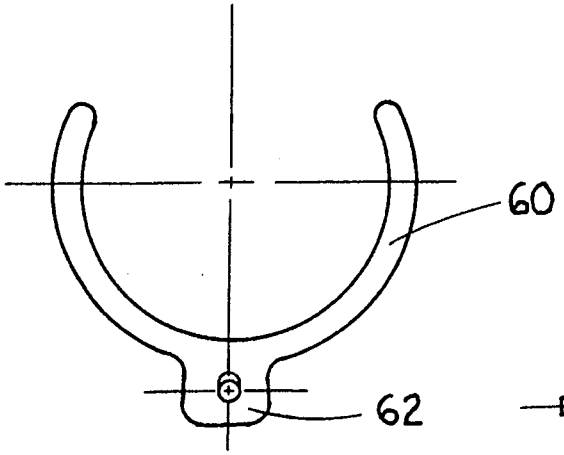
FIG. 4 is the end view of the device that attaches to the drill.
Figure 7:
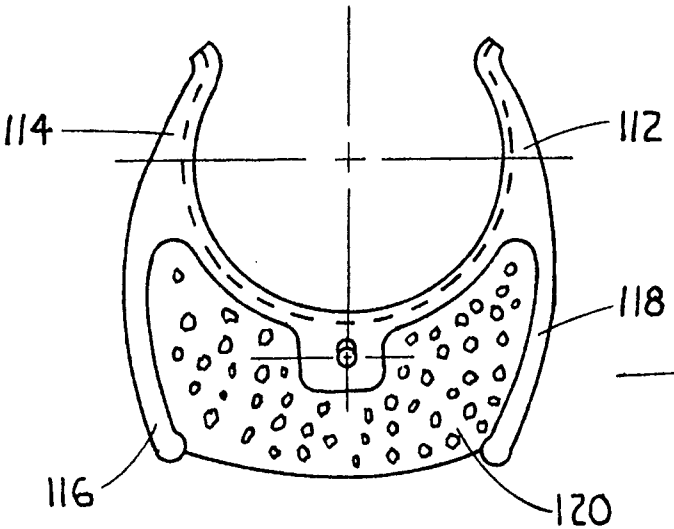
FIG. 7 is the end view of another embodiment of the device that attaches to a drill.

FIG. 4 is the end view of another design of the embodiment of FIG. 7. FIG. 9 is the side view of this design. In this design as in FIG. 1 the end portion of the C-shaped bracket are not flared outward and there are no groves.

Figure 8:
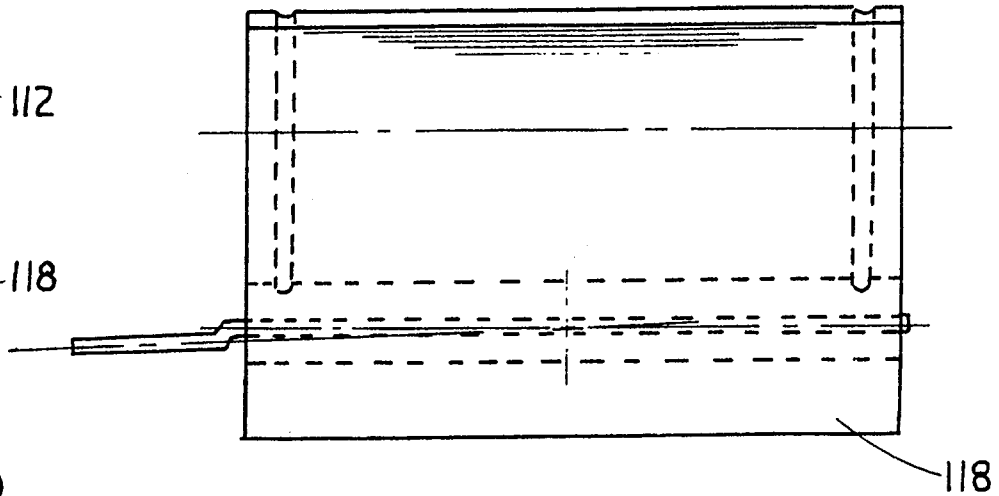
FIG. 8 is a side view of the embodiment shown in FIG. 7.

FIG. 7 shows another design for the embodiment of FIG. 3. FIG. 7 shows a better can releasing means. Attached to both sides 112 and 114 of the C-shaped bracket are wings 116 and 118. These wings 116 and 118 are attaches such that when an individual places inward pressure on the wings 116 and 118 the wings will open the C-shaped bracket slightly. By the wings 116 and 118 opening up the C-shaped bracket slightly the aerosol can within can be removed more easily. Between the wings 116 and 117 a foam 120 is placed. This foam is designed to be compressed by the pressure put on the wings 116 and 117 however, it is only can be compressed so far and thus keeps the wings from being compressed to far and breaking. FIG. 8 shows the side view of the embodiment of FIG. 7.

One of the unexpected results that the inventor found while oscillating the can with the sander or the drill is that the can will not only be oscillate by the motion of the device but also will rotate at a slow rate of speed within the C-shaped bracket that will cause better mixing of the paint and pigment.

Changes in modifications in the specifically described embodiment can be carried out without departing from the scope of the invention that is intended to be limited only by the scope of the claim.

What is claimed:

1. A device for attaching aerosol cans and small paint cans to a hand held electric sander with a vibrating surface for shaking comprising:

a. a C-shape clip with outer edges and an opening of approximately the size and length of an aerosol can made out of a resilient substance adapted such that the aerosol can or small paint can be pressed through the opening forcing the edges of the C-shape clip outward and once the can is in placed within said C-shape clip the edges of the C-shape clip will snap back into position to hold the can securely; and, b. a base to attach the C-shape clip; and, c. a means for attaching the C-shape clip and the base to a vibrating surface of the sander.

2. A device as in claim 1 wherein:

a. the means for attaching is a clip attached to the base that clips over the edges of the vibrating surface of the sander and attaches said device securely to the sander.

3. A device as in claim 1 wherein:

a. the C-shaped clamp has ends and said ends flare slightly outward whereby when a paint can is pressed against said ends, said ends will be forced outward allowing the C-shaped clamp to open and enabling the paint can to be easily placed inside.

4. A device for attaching aerosol cans and small paint cans to a hand held electric sander with a vibrating surface for shaking comprising:

a. a C-shape clip with an outer edge adapted to hold an aerosol can; and, b. a base attached to the C-shape clip; and, c. a means for attaching a C-shape clip and the base to the vibrating surface of the sander comprising:

(1) the base's dimensions are similar to those of the vibrating surface of the sander; and, (2) four opening are placed in the corner of the base; and, (3) four openings are placed in the corner of the vibrating surface of the sander; and, (4) four bolts are placed through the openings in the base and the openings in the vibrating surface of the sander; and, (5) four nuts are threadably attached to the bolts and tighten to hold the device to the sander securely.

5. A device that attaches to a drill with a chuck for shaking aerosol cans and small paint cans comprising:

a. a C-shape clamp adapted to hold the can; and, b. a base attached to the C-shape clamp; and, c. a bore in said base and said bore runs length wise with said base and the centerline of said bore is not parallel to the lengthwise centerline of said aerosol can or paint can; and, d. an axle that is adapted to fit within the bore and said base and is adapted to fit in a chuck of an electric drill; and, e. wherein an electric drill spins the axle, and said axle causes a C-shape clip to oscillate and shake the paint can or aerosol can.

6. A device as in claim 5 wherein:

a. the C-shaped clamp has ends and said ends flare slightly outward whereby when a paint can is pressed against said ends, said ends will be forced outward allowing the C-shaped clamp to open and enabling the paint can to be easily placed inside.

7. A device as in claim 5 further comprising:

a. two wings attached to the top of the outer edges of the C-shape clamp and said wings extends downward toward the base and slightly outward away from the base; and, b. whereby when said wings are forced towards each other the C-shape clamp opens and better allows an individual to remove a can from the C-shape clamp.

8. A device as in claim 7 further comprising:

a. a foam placed between the wings that is adapted to compressed when pressure is placed inwardly upon the wings.

9. A device that attaches to a drill with a chuck for shaking aerosol cans and small paint cans comprising:

a. a C-shape clamp adapted to hole the cans and said clamp has outer edges with tops; and, b. a base attached to the C-shape clamp; and, c. an axle that passes through the base and is adapted to fit within the chuck of an electric drill and said axle is bent such that said axle's centerline on the portion of the axle that fits within the drill before the bend is not parallel to the length wise centerline of the aerosol can or paint can when said aerosol can or paint can is placed within the C-shape clamp; and, d. wherein the electric drill spins the axle and the axle causes the C-shape clamp to oscillate and shake the paint can or aerosol can.

10. A device as in claim 9 wherein:

a. said axle when it comes out of the base is bent at the right angle and an obtuse angle so that when the drill spins the axle the C-shape clamp will oscillate and shake the paint can.

11. A device as in claim 9 wherein:

a. the axle when it comes out of the base is bent into obtuse angle such that when the drill spins the axle the C-shape clamp will oscillate and shake the can.

12. A device as in claim 9 wherein:

a. a C-shape clamp has ends and said ends flare slightly outward whereby when the paint can is pressed against said ends, said ends will be forced outward allowing the C-shape clamp to open and enabling the paint can to be easily placed inside.

13. A device as in claim 9 further comprising:

a. two wings attached to the top of the outer edges.

14. A device as in claim 13 further comprising:

a. a foam placed between the wings that is adapted to compress when the pressure is place inwardly upon the wings.

* * * * *